US008627870B2

(12) United States Patent
Leykamm

(10) Patent No.: US 8,627,870 B2
(45) Date of Patent: Jan. 14, 2014

(54) APPARATUS AND METHOD FOR LABELING CONTAINERS WITH DIFFERENT TYPES OF LABELS

(75) Inventor: Dieter Leykamm, Neutraubling (DE)

(73) Assignee: Krones AG, Neutraubling (DE)

( * ) Notice: Subject to any disclaimer, the term of this patent is extended or adjusted under 35 U.S.C. 154(b) by 0 days.

(21) Appl. No.: 12/806,297

(22) Filed: Aug. 10, 2010

(65) Prior Publication Data

US 2011/0041979 A1 Feb. 24, 2011

(30) Foreign Application Priority Data

Aug. 21, 2009 (DE) ..... 10 2009 043 827
Aug. 27, 2009 (DE) ..... 10 2009 043 880

(51) Int. Cl.
*B65C 3/00* (2006.01)

(52) U.S. Cl.
USPC ..... 156/566; 156/557; 156/556; 156/540; 156/362; 156/363; 156/567

(58) Field of Classification Search
USPC ..... 156/566, 556, 540, 362, 363, 364, 567, 156/557
See application file for complete search history.

(56) References Cited

U.S. PATENT DOCUMENTS

| | | | | |
|---|---|---|---|---|
| 2,804,961 | A * | 9/1957 | Carter | 198/447 |
| 3,567,559 | A * | 3/1971 | Dullinger | 156/571 |
| 5,464,495 | A | 11/1995 | Eder | 156/456 |
| 5,491,010 | A | 2/1996 | Eder | 428/35.7 |
| 6,058,985 | A | 5/2000 | Petri et al. | 141/168 |
| 6,098,381 | A | 8/2000 | Schmelzer | 53/557 |
| 6,708,470 | B2 | 3/2004 | Eiban et al. | 53/585 |
| 7,060,143 | B1 | 6/2006 | Eiban et al. | |
| 8,016,962 | B2 * | 9/2011 | Kursawe | 156/64 |
| 2002/0166640 | A1 | 11/2002 | Caprara et al. | 156/556 |
| 2002/0185212 | A1 | 12/2002 | Schaupp et al. | |
| 2004/0099379 | A1 | 5/2004 | Erich | 156/567 |
| 2004/0261363 | A1 * | 12/2004 | Deckert | 53/415 |
| 2006/0048417 | A1 | 3/2006 | Leykamm | |
| 2006/0065356 | A1 | 3/2006 | Leykamm | 156/250 |
| 2010/0163164 | A1 * | 7/2010 | Deonarine et al. | 156/229 |
| 2011/0126960 | A1 * | 6/2011 | Orlandi et al. | 156/84 |

FOREIGN PATENT DOCUMENTS

| | | |
|---|---|---|
| CN | 1297410 | 5/2001 |
| DE | 26 36 516 A1 | 2/1978 |
| DE | 30 41 057 A1 | 5/1985 |
| DE | 39 23 670 A1 | 1/1990 |
| DE | 41 14 889 | 11/1992 |
| DE | 41 25 472 A1 | 2/1993 |
| DE | 41 25 579 A1 | 2/1993 |

(Continued)

*Primary Examiner* — Jeff Aftergut
*Assistant Examiner* — Jaeyun Lee
(74) *Attorney, Agent, or Firm* — Davidson, Davidson & Kappel, LLC

(57) ABSTRACT

An apparatus (200) and a method for labeling containers (100) with different types of label is disclosed. To each of at least two labeling machines (1, 2) there corresponds an infeed star wheel (61, 62) and a discharge star wheel (81, 82). A container path (7) is formed, along which the containers (100) to be labeled are fed to the at least two labeling machines (1, 2) in a controlled manner. At least one type of label is processed with each of the at least two labeling machines (1, 2), wherein the types of label processed with the at least two labeling machines (1, 2) are different.

19 Claims, 8 Drawing Sheets

(56) References Cited

FOREIGN PATENT DOCUMENTS

| | | | | | |
|---|---|---|---|---|---|
| DE | 93 06 132 | | 6/1994 | | |
| DE | 44 42586 | | 6/1996 | | |
| DE | 298 06 838 | U1 | 6/1998 | | |
| DE | 601 10 498 | T2 | 2/2006 | | |
| DE | 602 08 736 | T2 | 9/2006 | | |
| DE | 10 2005 044 621 | A1 | 3/2007 | | |
| EP | 1167213 | | 1/2001 | | |
| EP | 1 091 877 | B1 | 4/2001 | | |
| EP | 1 164 082 | B1 | 12/2001 | | |
| EP | 1 167 213 | B1 | 1/2002 | | |
| EP | 1 412 279 | B1 | 4/2004 | | |
| EP | 1 251 074 | B1 | 1/2006 | | |
| EP | 1634 817 | A2 | 3/2006 | | |
| EP | 1 645 514 | A2 | 4/2006 | | |
| FR | 2527549 | | 12/1983 | | |
| GB | 2122570 | | 1/1984 | | |
| JP | 7069332 | | 3/1995 | | |
| JP | 07069332 | A | * 3/1995 | ..... | B65C 3/00 |
| WO | WO 2005068301 | A1 | * 7/2005 | ..... | B65C 9/00 |

* cited by examiner

APPARATUS AND METHOD FOR LABELING CONTAINERS WITH DIFFERENT TYPES OF LABELS

This claims the benefit of German Patent Application No. DE 10 2009 043 880.7, filed on Aug. 27, 2009 and of German Patent Application No. DE 10 2009 043 827.0, filed on Aug. 21, 2009 both of which are hereby incorporated by reference herein.

FIELD OF THE INVENTION

The present invention relates to an apparatus for labeling containers with different types of label.

Furthermore the invention relates to a method for labeling containers with different types of label.

BACKGROUND OF THE INVENTION

Such apparatuses and methods for labeling plastic bottles are prior art. From the German patent application DE 41 25 579 A1 furthermore an apparatus for labeling containers with thin walls is known, wherein the containers are engaged and stabilized by a bottle carrier with a carrier fork at fixed height for hanging the bottles by the neck collar only and by a centering piston engaging from above.

From the German part DE 602 08 736 T2 of the European patent EP 1251 074 B1 furthermore an apparatus for engaging and handling bottles in a labeling machine is known. This apparatus also comprises an element for engaging a bottle neck. This element is also shaped as a fork for engaging a protruding fringe or carrier ring of the bottles.

Furthermore from the German part DE 601 10 498 T2 of the European patent EP 1 167 213 B1 a labeling machine is known with a rotary carrier at a top side of the machine. An additional engagement means holds the containers to be labeled at their open or upper section and at their carrier ring.

A plurality of types of label exists. Depending on requirements one and the same container is to be labeled with different labels, for example a tinfoil label on the bottle neck, a different label on the side of the bottle. In principle three labeling systems can be distinguished, which are used for applying labels on containers.

One possibility for labeling containers is applying an adhesive label to the containers. For the adhesive label furthermore a plurality of labeling methods can be distinguished. These are wet labeling, tinfoiling, hot-glue labeling, wrap-around labeling and self-adhesive labeling.

The European patent EP 1 412 279 B1 discloses a labeling machine, by which articles (bottles, cans, and the like) can be provided with a label. The labeling machine affords the possibility to provide the articles with different labels according to adhesive labeling. The articles to be labeled are transported on a carousel. On the circumference of the carousel the various labeling systems of various design (wet-glue system, hot-glue system, dispenser system for self-adhesive labels, labeling system for rolled labels or the like) can be connected. The individual labeling systems normally each comprise an individual base, and as the case may be also at least one individual drive system. With the apparatus proposed here it is possible to apply different types of label (adhesive labels) on articles, depending on customer requirements.

A further possibility of labeling is applying so-called wrap-around labels, which consist in a single sleeve and are cut from the endless sleeve according to the labeling requirements of the articles. The cut sections of the sleeve films—so-called sleeves—are pulled over the circumference of the container in the labeling machine. They thus constitute a label encompassing the container. Two different methods are used for labeling with film sleeves. For the stretch-sleeve method the labels of stretchable film are slipped over the container, the film adapting to the contour of the container once the mechanical stretching of the film applied for slipping it on the container has been removed. For the shrink-sleeve method on the other hand, the film at first is loosely attached to the container and then shrinks precisely to the contour of the container under the effect of temperature. The effect of temperature usually is achieved in a so-called shrinking tunnel.

The European patent EP 1 164 082 B1 discloses an apparatus for sliding label sleeves onto containers. The containers to be labeled are transported on a carousel past so-called apertured sliders. While the label is being slid onto the container by the apertured sliders, the container is supported at the side, in particular close to the bottom. The label now is loosely attached to the container as a so-called sleeve. In a downstream shrinking tunnel the label attaches tightly to the container to be labeled.

The European patent EP 1 091 877 B1 discloses a method and an apparatus for applying label sleeves on objects. The containers to be labeled are transported past the labeling stations on a rotary table. The individual label sleeves are cut from the endless sleeve by a cutting device. The label sleeve is seized at its leading edge by an expansion jaw unit and slipped over the objects to be labeled in axial direction, while the objects to be labeled are in a continuous movement at an even height. Once the expansion jaws have disengaged from the label, the label relaxes and attaches tightly to the object to be labeled. This method of labeling is also known as stretch-sleeve method.

The European patent application EP 1 645 514 A2 discloses a method and an apparatus for providing containers with a wrap-around label. The wrap-around label exhibits a leading and a trailing edge of a rigid material, in particular a cardboard. For the labeling method the label material is brought up to the side of the container to be labeled with its leading edge and is at least temporarily attached to it. Then the label is spooled circumferentially onto the container, and the trailing edge attached abutting the leading edge. In the labeling process the containers are transported past the individual labeling stations or devices by a carousel. After exiting the labeling machine the labeled containers pass through a UV tunnel, in which intense cross-linking and hardening of the hot-glue occurs by exposure to UV radiation.

The European patent application EP 1634 817 A2 also discloses an apparatus for labeling an article which exhibits a container section shaped radially inwards, which is also to be covered with the label. The article is labeled with a wrap-around label, wherein the label material is shrinkable. To this end first a leading edge of the label material is attached to the object. The trailing edge of the label material abuts the leading edge once labeling is complete. After exiting the labeling machine the labeled containers pass through an UV tunnel, in which a hardening or cross-linking of the hot-glued spots is conducted. Afterwards the containers pass the shrinking tunnel, in which the label material attaches tightly to the container.

Providing containers with a wrap around label is disclosed in DE 41 25 472 A1. In a continuous process the sealable material is taken from a rolled supply, an individual label is separated and then brought up to the container with a leading edge, attached by at least one narrow adhesive area located in the region of the leading edge, spooled onto the container by a rotation of the container, and afterwards connected by sealing the trailing label edge to the leading label edge.

The German patent application DE 10 2005 044 621 A1 discloses a method is for rotational use of reusable containers, especially beer bottles in which the bottle is filled by the original bottler, sealed, labeled and put on the market. The returnable empty bottle cleaned and cleared of labels by another bottler and refilled and relabeled by this second bottler with another label so that the identity of the original bottler is hidden but which is attached by an adhesive which would allow the second label to be washed off.

A machine which fits stoppers to bottles in disclosed in DE 39 23 670 A1. The stoppers are attached to the bottle by a wire clip. The machine has four rotating tables and the bottles and stoppers are transported to and from these tables by conveyors and star wheels.

In U.S. Pat. No. 4,388,143 a method and apparatus for affixing strip labels to container closures is disclosed. German patent application DE 26 36 516 A1 discloses a bottle filing machine in connection with two closing machines and a downstream bottle handling machine.

U.S. Pat. No. 6,098,381 shows a heat shield, in the form of a blower, oriented between a heat source and a plurality of containers, interrupts the heat transmission onto fittings and the containers. The heat source is in the form of a hot air fan. The blower produces an air curtain between the containers and the hot air fan.

The German utility model DE 93 06 132 discloses a bottle handling device which hat a discharge star wheel. Two different conveyers leading away form said star wheel.

U.S. Pat. No. 6,058,985 shows a set-up table or conveyor system for bottle handling machines with inlet and outlet star wheels and corresponding guide rails for the bottles. The drive mechanisms for the individual star wheels are located below and at a distance from the star wheels. The drive mechanisms and the associated drive shafts are covered by hoods or covers that can extend to the bottle transport level.

SUMMARY OF THE INVENTION

No prior art labeling machine can process different types of label, like adhesive labels and shrink labels, at the same time. According to prior art the various labeling machines only afford the possibility to either process adhesive labels only, wherein it is already possible to process the various different adhesive labels with a single labeling machine, wherein various labeling stations are connected to a carousel, which transports the containers to be labeled past the labeling stations. Additionally, separate labeling machines have to be used for the stretch-sleeve labels or the shrink-sleeve labels.

It is an object of the present invention to provide an apparatus which allows to apply various types of labels on articles without retooling. Applying the various labels shall be possible under control and arbitrarily.

The present invention provides an apparatus for labeling containers with different types of labels. The apparatus has at least two labeling machines each of which has associated therewith an infeed star wheel and a discharge star wheel. A container transport path is formed, along which the containers to be labeled are feedable under control to the at least two labeling machines. At least one type of label is processable with each of the at least two labeling machines. The types of label processed with the at least two labeling machines are different.

A further object of the invention is to provide a method by which various types of label can be applied on the articles entering the apparatus without requiring a down-time and retooling of the apparatus.

The present invention also provides a method for labeling containers with different types of labels, comprising the steps of:

controlling an apparatus for labeling containers by a control system in such a way that the containers to be labeled are fed to at least two labeling machines along a container transport path in dependence on the type of label to be applied;

processing at least one type of label with each of the at least two labeling machines, wherein the types of label processed with the at least two labeling machines are different; and transferring the containers to each of the at least two labeling machines via infeed star wheels in a controlled manner.

The container transport path guides the containers to be labeled to the labeling machines. It is thus possible, for example, that adhesive labels of different types are processed with the first labeling machine. It is also conceivable that direct printing of the labels onto the containers to be labeled is possible with the first labeling machine. Then, in a possible second or further labeling machine sleeve labels are processed. These for example can be shrink-sleeve labels and/or stretch-sleeve labels.

According to a preferred embodiment the apparatus comprises a first labeling machine and a second labeling machine. To the first labeling machine there can be connected at least one unit for adhesive labels and/or one unit for direct printing of the labels on the containers. The second labeling machine is a unit for applying sleeve labels about the containers.

In order to process a sufficient capacity of containers with the second labeling machine, the second labeling machine consists of a first carousel and a second carousel, both of which are designed for applying sleeve labels about the containers.

Therein the first carousel and the second carousel may be designed for applying stretch-sleeve labels and shrink-sleeve labels. It is also conceivable that one of the two carousels only processes stretch-sleeve labels and the other carousel of the second labeling machine only processes shrink-sleeve labels.

The apparatus comprises a control system. By the control system the individual containers can be routed arbitrarily to the at least two labeling machines, where the corresponding label is applied. The control system, among other things, makes efficient use of the capacity of the apparatus possible. Thus, for example, a first container may be labeled at the first labeling machine, while the second container, which perhaps is to be labeled with a different type of label, is redirected to the second or further labeling machine and there is provided with a different type of label.

In principle three types of label can be distinguished, namely the adhesive labels, the stretch-sleeve labels, and the shrink-sleeve labels. According to a preferred embodiment of the invention the first labeling machine of the apparatus comprises a unit for processing adhesive labels of broadly varying design. The adhesive labels may also be wrap-around labels. Furthermore the first labeling machine may also be connected with a unit for direct printing of the labels onto the containers. Additionally the labeling machine comprises a unit for aligning the containers. The containers, which preferentially are bottles, are aligned according to contour or lobes in the zone of the bottle bottom or the bottom side.

Thus it is possible for a customer to apply arbitrary types of label on the containers in a constant stream of containers. Thus it is not necessary for the containers to be labeled differently to be removed from container transport and transported to a different labeling machine in order to apply the different type of label. In most cases this problem is solved by providing a further labeling machine which can apply the different type of label, and the containers then are supplied in a constant stream, wherein all the containers of the incoming container stream are labeled with the same label.

According to the invention the second labeling machine then comprises a unit for applying sleeve labels round the containers. A third labeling machine also comprises a unit for applying shrink-sleeve labels round the containers.

It is evident that the apparatus need not be restricted to only two or three labeling machines. For example two labeling machines are provided, one of which processes stretch-sleeve labels and a further labeling machine processes the shrink-sleeve labels. Furthermore a labeling machine for adhesive labels is provided to which then the required units for the various adhesive labels are connected. The eventual design of an apparatus for labeling containers is determined by the requirements of the customer. If for example a customer in an incoming container stream has plural containers to be labeled with an adhesive label, he will provide more than one labeling machine for processing adhesive labels. It is also conceivable, as has already been mentioned, that the apparatus is designed in such a way that several labeling machines are provided for processing shrink-sleeve labels, if this is required by the customer and if the requirements are such that a plurality of containers in the incoming container stream can be processed with shrink-sleeve labels.

In particular the container transport path within the apparatus is such that the containers are transported through the apparatus at an even height. Within the apparatus the containers in the container transport path at least on sections are maneuverable by a neck section. Maneuvering the containers by the neck section preferentially is done in the labeling of empty containers. Here, too, transport is at an even height.

In a discharge conveyor of the apparatus a curing unit and/or a film shrinking unit is provided. The curing unit can be a UV tunnel and the film shrinking unit can be a shrinking tunnel. The UV tunnel essentially is provided for cross-linking or hardening of the hot-glue. The shrinking tunnel is provided for shrinking the shrink-sleeve labels or the wrap-around adhesive labels onto the containers, thus adapting and attaching the labels to the contours of the container to be labeled.

In labeling empty containers and the maneuvering of containers by the neck section this involves the film shrinking unit is a shrinking carousel.

The method according to the invention for labeling containers with different types of label is characterized in that a control system controls the apparatus for labeling containers in such a way that the containers to be labeled are fed to at least two labeling machines in dependence on the type of label to be applied. Each of the at least two labeling machines processes at least one type of label. The types of label processed at the at least two labeling machines are different from each other. Thus for example at the first labeling machine a type of adhesive label may be processed and at the second or further labeling machine a sleeve-type label may be processed. The containers are transferred under control to each of the at least two labeling machines by infeed star wheels.

The containers are controlled in such a way within the apparatus by the infeed star wheels that the containers are fed directly to one of the at least two labeling machines, for example to the second labeling machine, for a type of label to be applied which differs from the type of label applied with the first labeling machine.

Thus a controllable infeed star wheel is provided in the container transport path before the first labeling machine. The containers in the container transport path can be moved along the container transport path directly to the selected labeling machines (for example the second labeling machine) by the controllable infeed star wheel. In the second labeling machine then a type of label is applied on the containers which differs from the type of label applied in the first labeling machine. The direct feeding of the containers to the second labeling machine is advantageous, because in this way the efficiency of the apparatus is not diminished, as containers which need not be labeled by the first labeling machine do not pass through the first labeling machine, but are fed directly to the at least second further labeling machine and do not require space in the first labeling machine.

Also units for aligning, dating and/or checking the containers, in particular bottles, may correspond to the labeling machines which constitute the apparatus. The possible types of labels which can be processed simultaneously with the apparatus are stretch-sleeve labels, shrink-sleeve labels, wrap-around labels with hot-glue, a wrap-around label which is shrinkable and applied to the container with a UV curable glue, self-adhesive labels, as well as a combination of wrap-around, sleeve and self-adhesive label. The apparatus according to the invention allows to provide a machine concept for labeling containers, by which it is possible to process arbitrary types of label, if required. Therein the labels can be applied to full or empty containers. The customer thus has the possibility to react to all requirements of the market, like for example changes in marketing, label layout, increase of the price of labels, glue, etc. The apparatus according to the invention provides the possibility for the labeling machines in the apparatus to be quickly and easily retooled for different configurations of the containers.

BRIEF DESCRIPTION OF THE DRAWINGS

Below embodiments shall illustrate the apparatus according to the invention and the method according to the invention and their advantages with reference to the accompanying figures.

DETAILED DESCRIPTION

Figure 1:
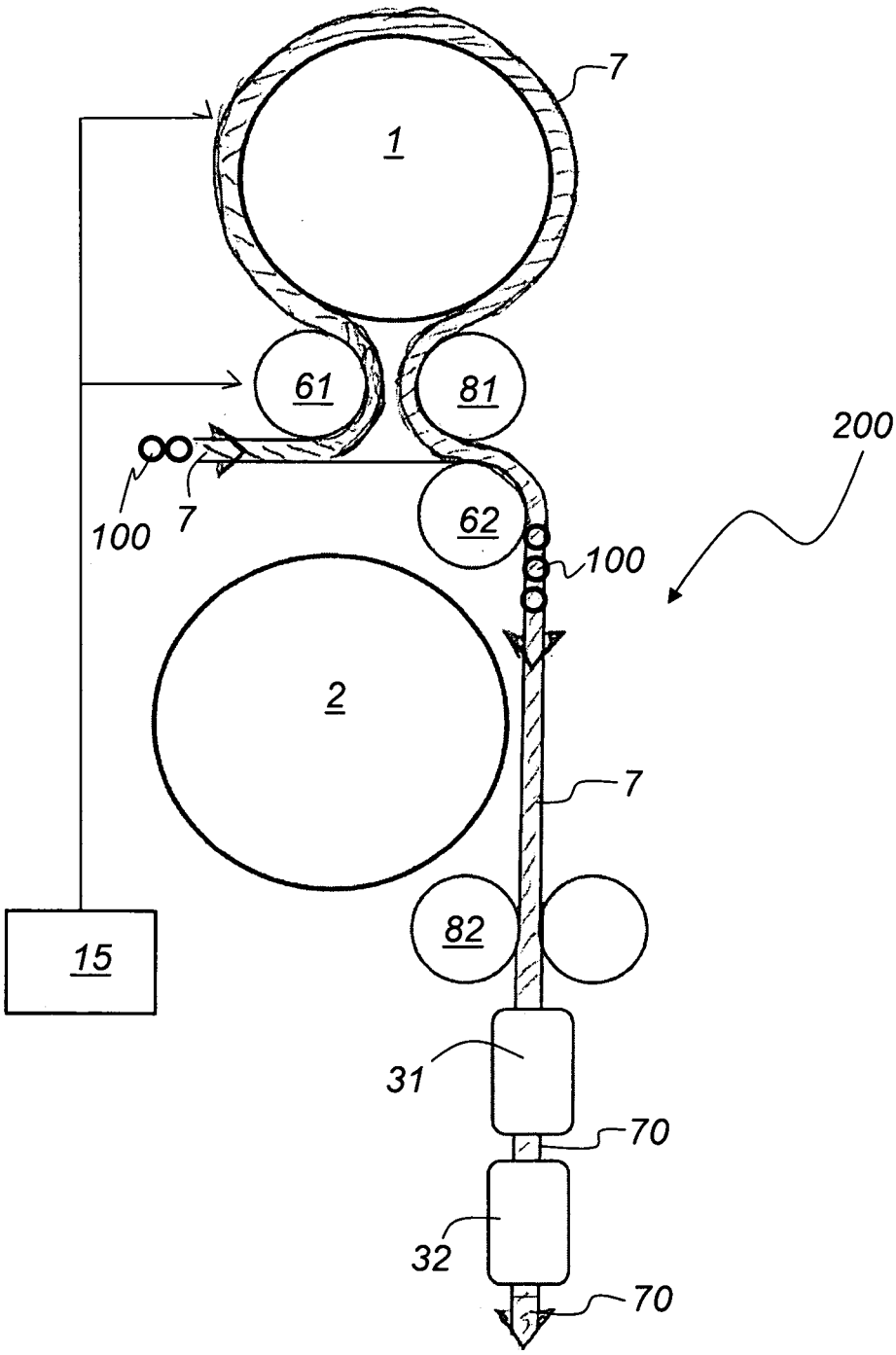
FIG. 1 shows a schematic representation of a first embodiment of the apparatus according to the invention, wherein two labeling machines cooperate.

Identical reference numerals are used for like elements of the invention or elements of like function. Furthermore only those reference numerals are shown in the individual figures, which are necessary for the description of the respective figure.

FIG. 1 shows a schematic view of the apparatus 200 according to the invention, wherein a first labeling machine 1 and a second labeling machine 2 cooperate. The first labeling machine 1 and the second labeling machine 2 are connected with each other by a container transport path 7. To the apparatus 200 there corresponds a control system 15, by which, according to choice, the containers 100 to be labeled (in FIG. 1 a few containers 100 are shown by way of example) are feedable to the first labeling machine 1 or to the second labeling machine 2. Before the first labeling machine 1 a controllable infeed star wheel 61 is provided, by which the containers 100 can be fed to the first labeling machine 1 or to the second labeling machine 2.

The containers 100 to be labeled by the first labeling machine 1 are transported via the infeed star wheel 61, round the first labeling machine 1, via the discharge star wheel 81, and past the infeed star wheel 62 and the discharge star wheel 82 to the discharge conveyor 70. These containers 100 thus do not run via the second labeling machine 2.

The containers 100 to be labeled by the second labeling machine 2 are transported directly to the second labeling machine 2. These containers 100 thus do not run via the first labeling machine 1, but are transferred to the second labeling machine 2 by the controlled infeed star wheel 62. This has the advantage that the containers 100 to be labeled with the second labeling machine 2 need not be moved via the first labeling machine 1 and thus do not occupy space unnecessarily. This increases the efficiency of the entire apparatus 200 significantly. Thus it is possible that for example the first labeling machine 1 is not burdened with containers 100 which need not be labeled by the first labeling machine 1.

In the embodiment of FIG. 1 it is also shown that due to the controlled infeed star wheel 62 at the second labeling machine 2 the containers labeled in the first labeling machine 1 do not run via the second labeling machine 2 also. The containers labeled in the first labeling machine 1 thus run past the second labeling machine 2 and thus reach the discharge conveyor 70 directly.

A UV tunnel 31 and a shrinking tunnel 32 are provided in the discharge conveyor 70 after the second labeling machine 2. The UV tunnel 31 is situated before the shrinking tunnel 32 in the discharge conveyor 70. In the UV tunnel 31 a hot-glue is cross-linked, in order for the labels 101 (see FIG. 8) not to peel off during the shrinking process in the shrinking tunnel 32.

Figure 2:
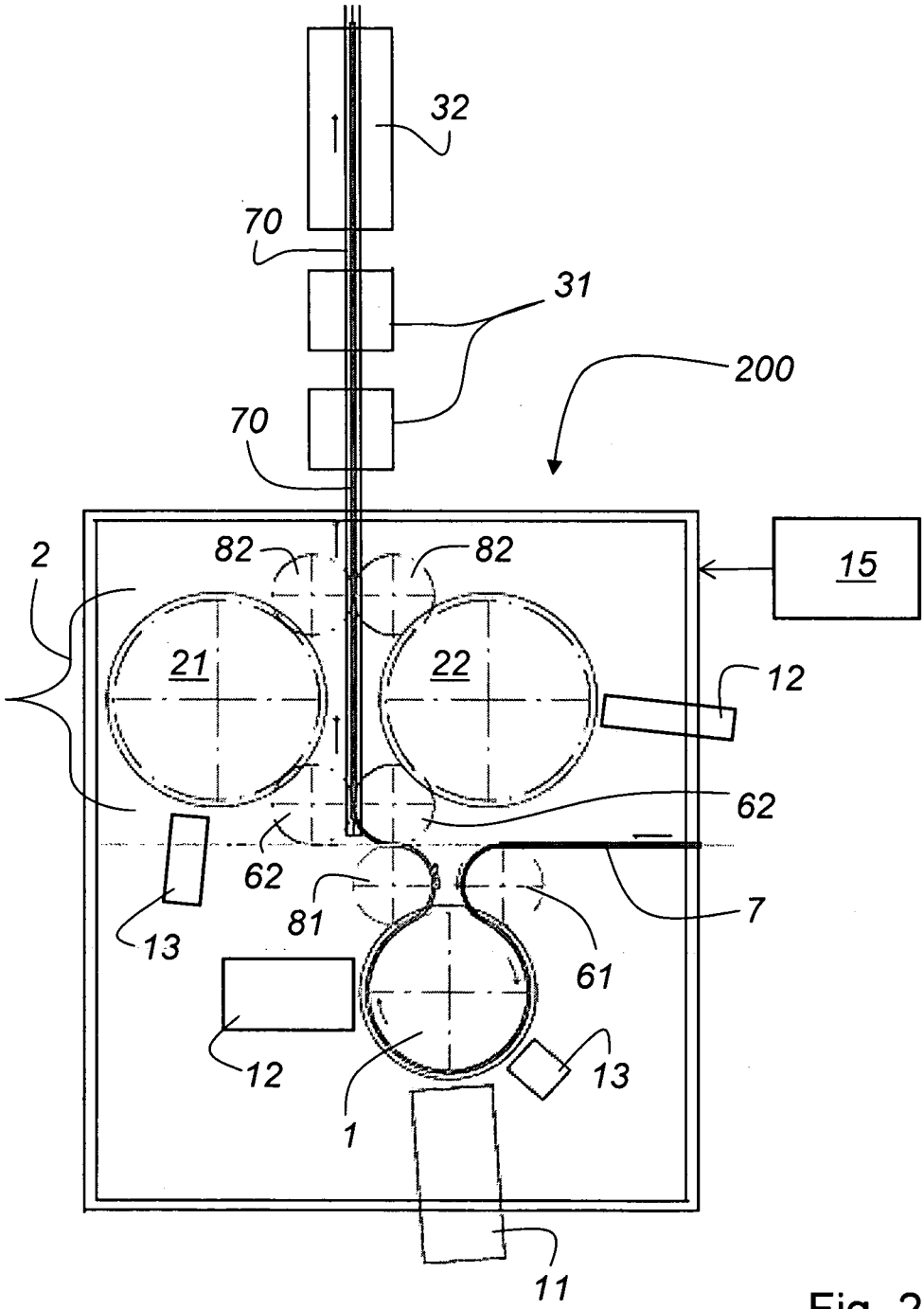
FIG. 2 shows a further embodiment of the apparatus according to the invention, wherein the second labeling machine comprises two carousels.

FIG. 2 shows a schematic arrangement of the apparatus 200 for labeling containers 100, which comprises a first labeling machine 1 and a second labeling machine 2. As already mentioned in the description of FIG. 1, the first labeling machine 1 and the second labeling machine 2 are connected with each other via the container transport path 7. This implies that the containers 100 are fed under control to the first labeling machine 1 and to the second labeling machine 2 via the container transport path 7. In the discharge conveyor 70 at least a curing unit 31 and a film shrinking unit 32 are provided. In the embodiment shown here two UV tunnels 31 as curing units and one shrinking tunnel 32 are provided in the discharge conveyor 70.

In FIG. 2 the container transport path 7 is shown to run via the first labeling machine 1 only. The direction of motion of the containers 100 is indicated in FIG. 2 with arrows. The infeed star wheel 61, which in the container transport path 7 is situated before the first labeling machine 1, is controlled by the control system 15 in such a way that the containers 100 run via the first labeling machine 1. After labeling in the first labeling machine 1 the containers are transported along the container transport path 7 via the discharge wheel 81 and past the second labeling machine 2 by a controlled cooperation of the two infeed star wheels 62 of the second labeling machine 2.

In the embodiment of the apparatus 200 shown here the second labeling machine 2 consists in a first carousel 21 and a second carousel 22. Preferentially the first labeling machine 1 is designed for processing adhesive labels of the broadest variety of types. The second labeling machine 2 with the first carousel 21 and the second carousel 22 is designed in such a way that sleeve labels can be processed with the second labeling machine 2. By the second labeling machine 2 for example shrink-sleeve labels and stretch-sleeve labels may be applied on the containers 100 in parallel in the first carousel 21 and in the second carousel 22.

Depending on requirements plural units 11 for processing various adhesive labels may be assigned to the first labeling machine 1. Furthermore a printing unit 12 for printing labels directly on the container 100 may also be assigned to the first labeling machine 1. It is also conceivable that a printing unit 12 is assigned to the second labeling machine 2, which partly prints on the sleeve labels already applied on the bottle 100. Also, to the first labeling machine 1 and the second labeling machine 2 there may be assigned check or control systems 13, like for example a camera, a laser scanner, an alignment station or the like, which check the containers 100, check the labels, and possibly check the image printed on the label. The containers 100, which in the apparatus 100 shown in FIG. 2 have been labeled with the first labeling machine 1, can be transported directly between the first carousel 21 and the second carousel 22 of the second labeling machine 2 and thus reach the discharge conveyor 70 directly. The direction of motion of the containers in the container transport path 7 is indicated by arrows and the bold line.

Figure 3:
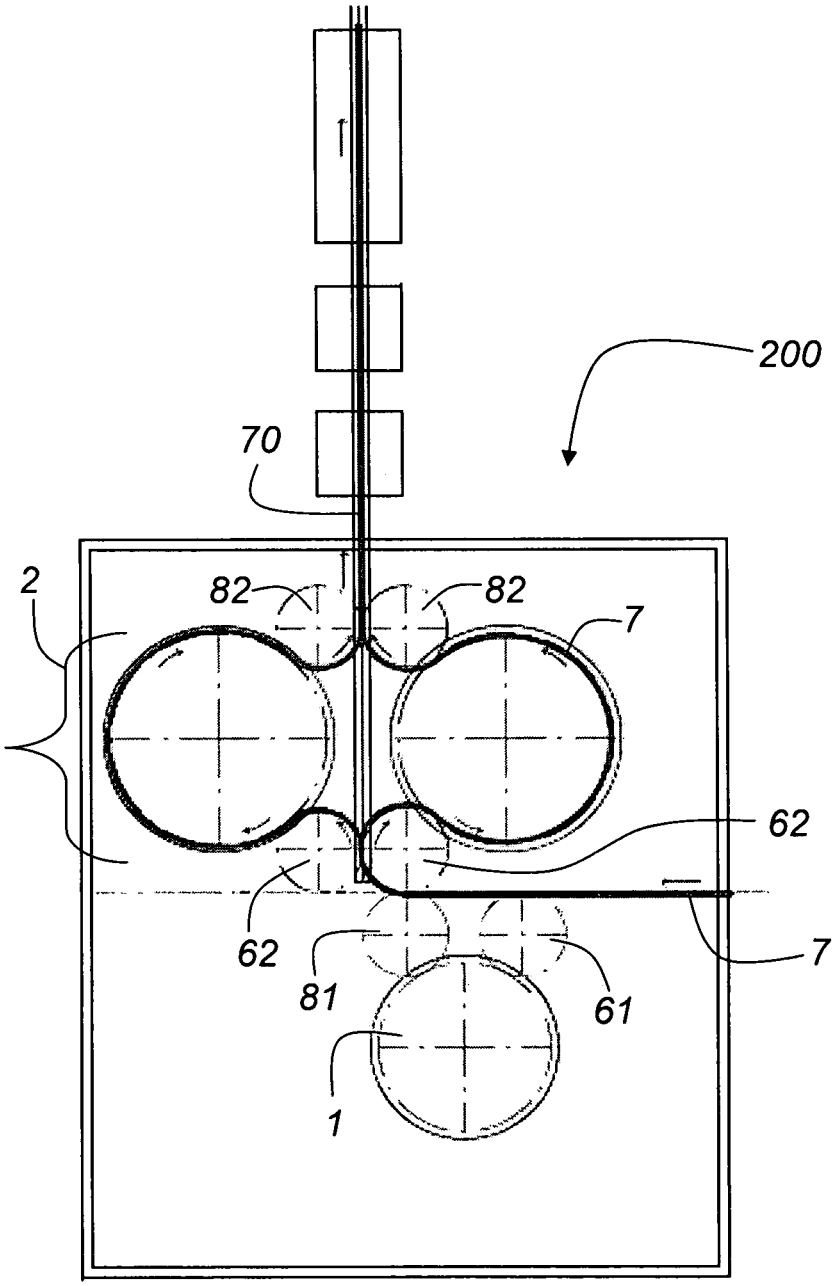
FIG. 3 shows a representation of the apparatus according to the invention of FIG. 2, wherein the container transport path runs via the second labeling machine.

FIG. 3 shows the situation of the transport of containers in the apparatus 200, wherein the infeed star wheel 61 of the first labeling machine 1 is controlled in such a way that the containers 100 are fed directly to the respective infeed star wheel 62 of the first carousel 21 or of the second carousel 22 of the second labeling machine 2, then round the first carousel 21 or round the second carousel 22 to the respective discharge star wheel 82, and to the discharge conveyor 70. The direction of motion of the containers 100 in the container transport path 7 also is indicated by arrows and the bold line.

Figure 4:
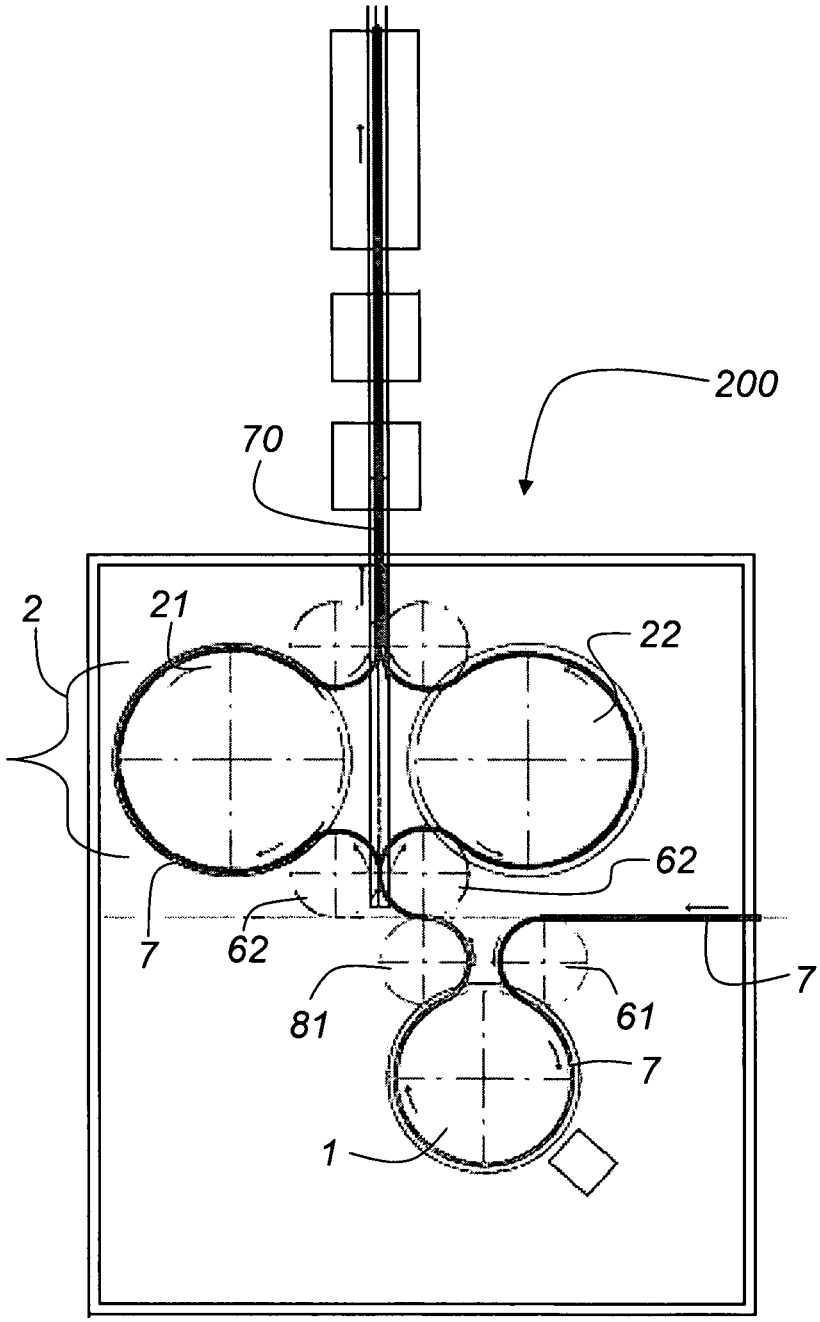
FIG. 4 shows a representation of the apparatus according to FIG. 2, wherein the container transport path runs via the first labeling machine and the second labeling machine.

FIG. 4 shows the situation of the transport of containers in the apparatus 200, wherein the infeed star wheel 61 of the first labeling machine 1 is controlled in such a way that the containers 100 are fed to the first labeling machine 1 first. In the first labeling machine 1 adhesive labels and/or directly printed images are applied on the containers 100. For direct printing on the containers 100 ink-jet printing is preferred. Other methods of printing, like for example laser printing, dye-sublimation printing or the like may well be conceived of and may be integrated into the apparatus should need be. From the discharge star wheel 81 of the first labeling machine 1 the containers 100 reach the infeed star wheels 62 of the first carousel 21 and of the second carousel 22 of the second labeling machine 2. These infeed star wheels 62 are controlled in such a way that the containers 100, already with at least one label applied, are fed to the second labeling machine 2 from the first labeling machine 1, in order to additionally apply a sleeve-label on the containers 100. The direction of motion of the containers 100 in the container transport path 7 is also indicated by arrows and the bold line.

The apparatuses 200 schematically shown in FIGS. 2 to 4 are particularly suited for labeling containers 100 which already have been filled. The containers 100 thus can be moved between the first carousel 21 and the second carousel 22 as well as within the first carousel 21 and the second carousel 22 while standing. A maneuvering of the containers 100 by the neck section 105 (see FIG. 8) at least on sections within the apparatus 200 is also possible.

Figure 5:
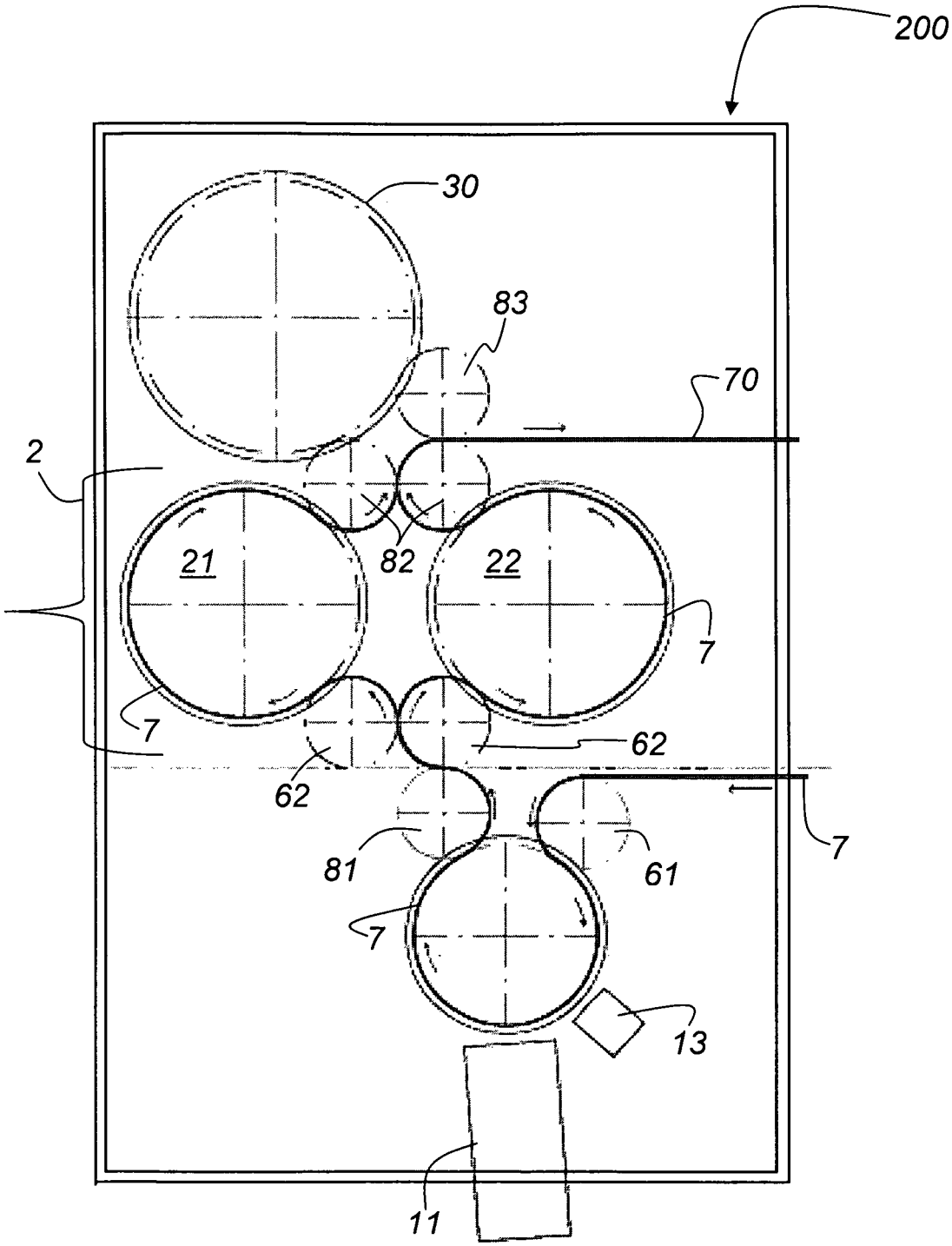
FIG. 5 shows a representation of a further embodiment of the apparatus according to the invention, wherein the apparatus comprises a shrinking carousel.

FIG. 5 shows a representation of a further embodiment of the apparatus 200 according to the invention, wherein the apparatus 200 comprises a shrinking carousel 30. By the apparatus 200 described in FIGS. 5 and 6 in particular unfilled containers 100 are labeled. Maneuvering of the containers 100 in the container transport path 7 at least on sections is by a neck section 105 (see FIG. 8) of the containers 100. In FIG. 5 the situation is shown that the containers 100 to be labeled are fed to the first labeling machine 1 by the infeed star wheel 61 and there are correspondingly labeled by the assigned units. After the containers 100 have exited the first labeling machine 1 via the discharge star wheel 81, the containers 100 are fed to the first carousel 21 and the second carousel 22 of the second labeling machine 2 by the infeed star wheels 62. The containers 100 with only an adhesive label applied exit the second labeling machine 2 via the discharge star wheels 82 of the second labeling machine 2 and the discharge star wheel 83 of the shrinking carousel 30 in direction of the discharge conveyor 70. The direction of motion of the containers 100 in the container transport path 7 is also indicated by arrows.

Figure 6:
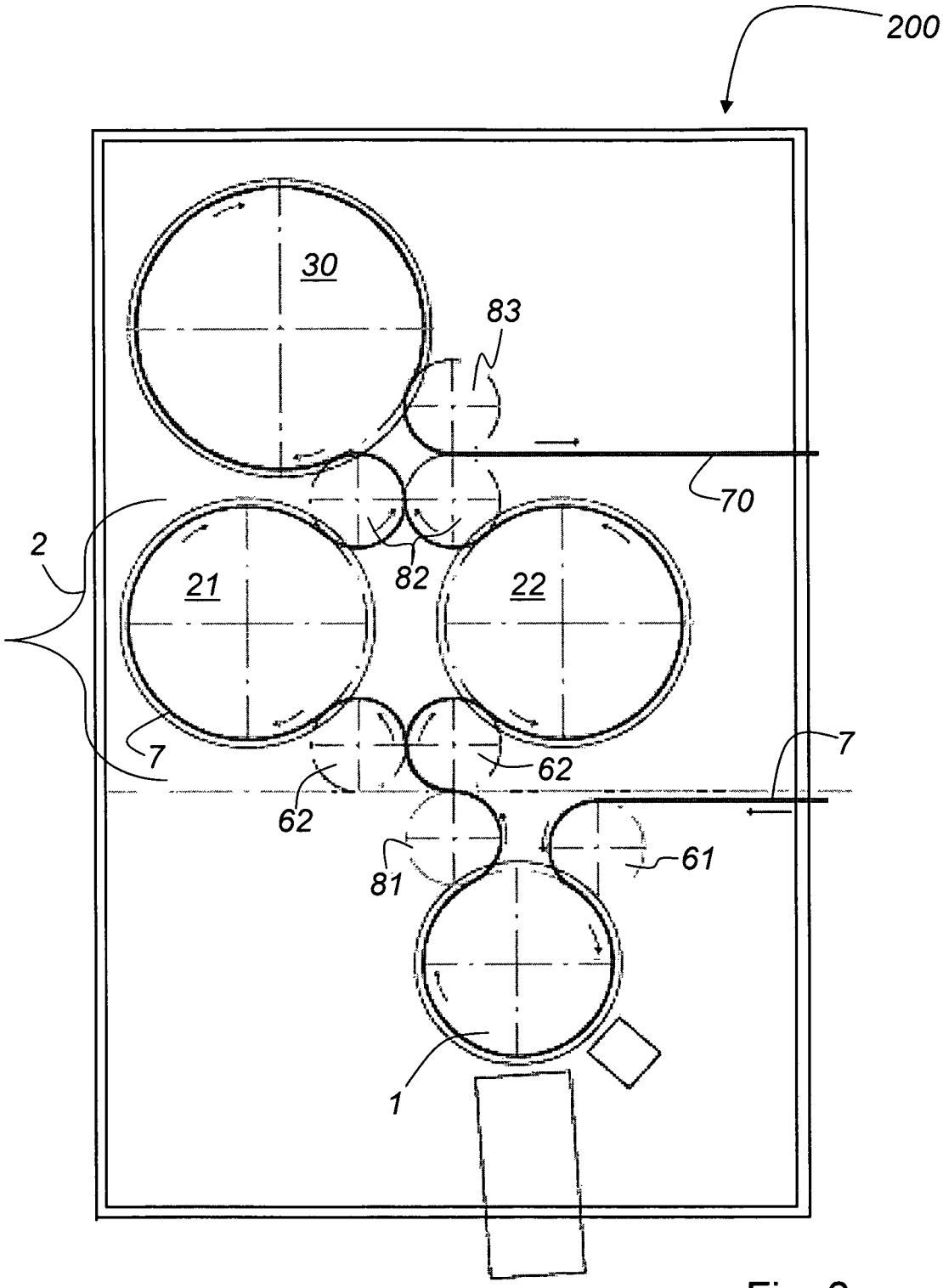
FIG. 6 shows a representation of the apparatus of FIG. 5, wherein the containers are passed via the shrinking carousel before exiting via the discharge conveyor.

FIG. 6 shows the situation that sleeve labels are applied on the containers 100 in the second labeling machine 2. It is also possible that labels are applied on the containers 100 in the first labeling machine. The discharge star wheel 82 of the first carousel 21 of the second labeling machine 2 acts as infeed star wheel of the shrinking carousel 30. All containers 100 which have a shrinkable label applied, are passed via the shrinking carousel 30, in order for the labels to attach tightly to the contour of the container. The containers 100 exit the shrinking carousel 30 via the discharge star wheel 83 and reach the discharge conveyor 70. The direction of motion of the containers 100 in the container transport path 7 is also indicated by arrows.

Figure 7:
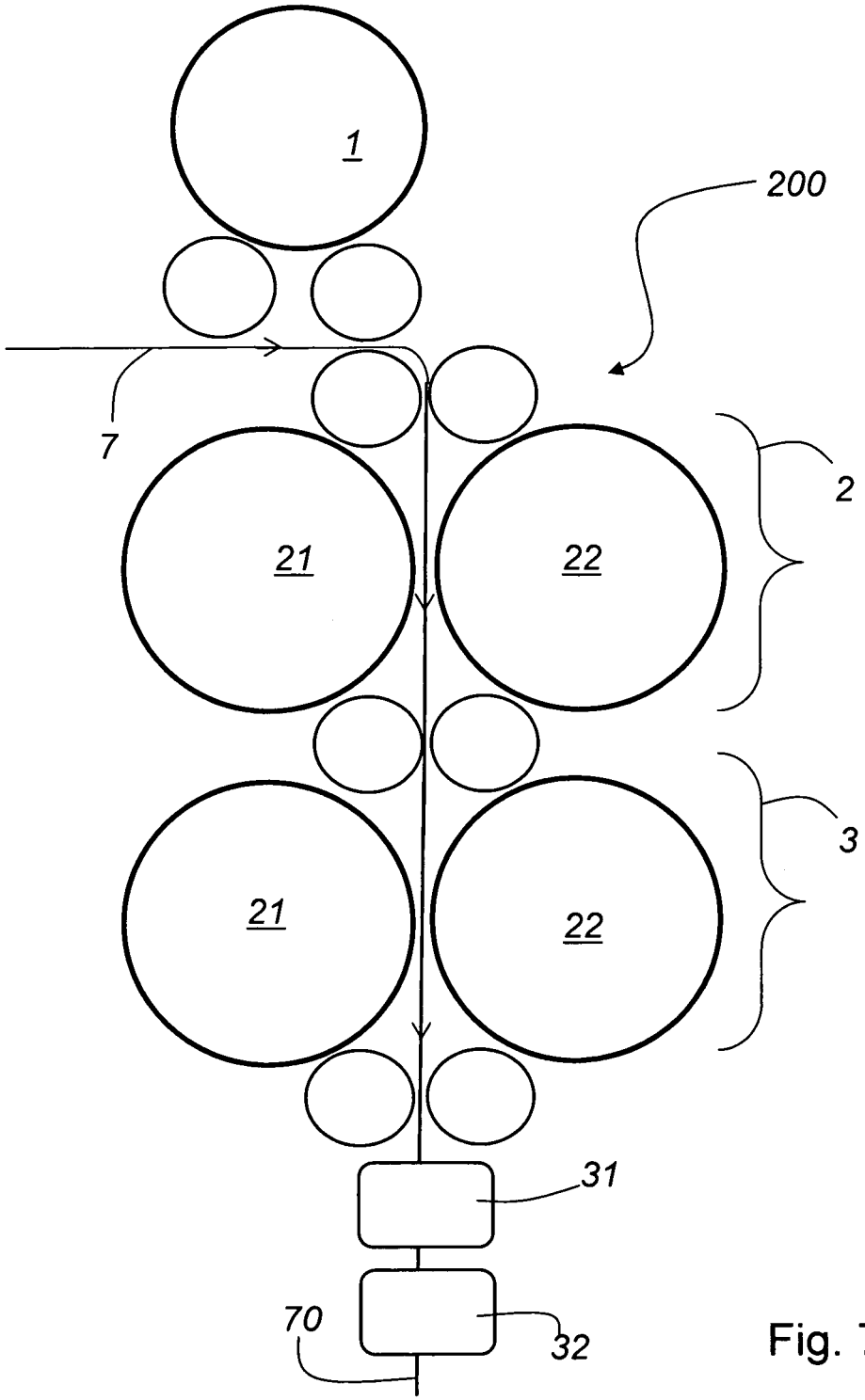
FIG. 7 schematically shows a further embodiment of the apparatus, comprising three labeling machines.

FIG. 7 schematically shows a further embodiment of the apparatus 200, comprising a first labeling machine 1, a second labeling machine 2, and a third labeling machine 3. Although the third labeling machine 3 in the embodiment also comprises a first carousel 21 and a second carousel 22, this is not to be taken as a limitation of the invention. The third labeling machine 3 or any further labeling machine of the apparatus 200 may be designed according to the labeling requirements.

Figure 8:
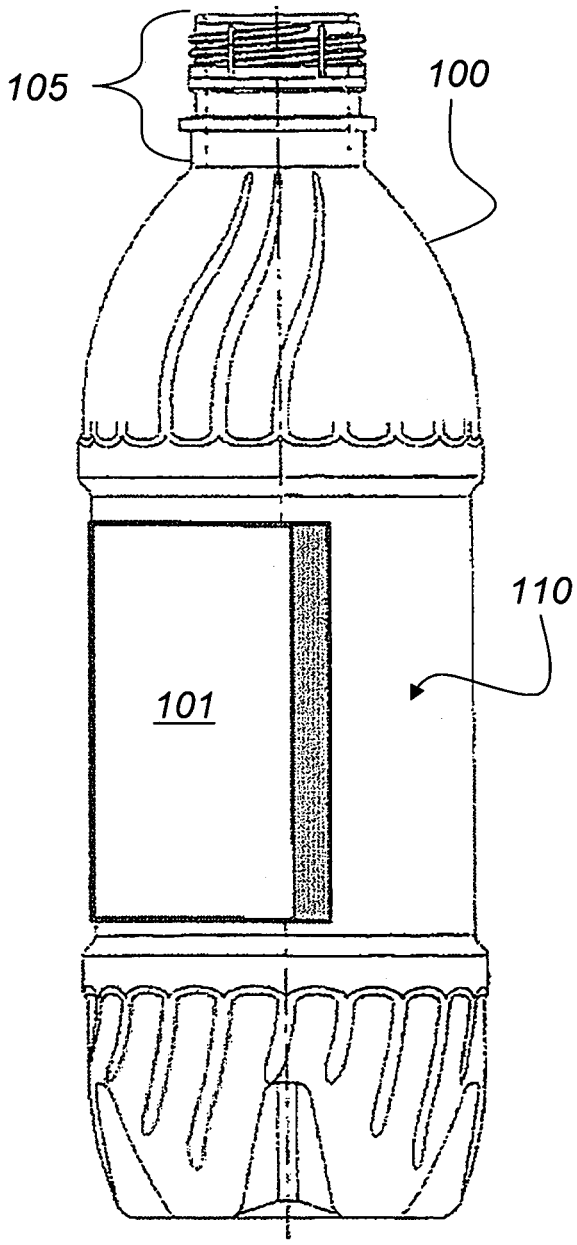
FIG. 8 shows a container which can be processed with the apparatus according to the invention.

FIG. 8 shows a container 100. The container is a bottle 100, which has a label 101 applied at a circumferential section 110 of the bottle 100. It is obvious here that the label 101 is not a wrap-around label. The label 101 only partially reaches round the circumference 110 of the bottle 100. It is possible, according to the invention, to provide labels 101 to the broadest variety of containers 100 and to design the labels correspondingly. Depending on the container 100 to be labeled for example a cutting device may be adapted by a control unit in such a way that labels of the desired length are cut from an endless film sheet, in order for the labels to reach round the circumference of the container completely. As has already been disclosed in the description of some embodiments of the invention, empty containers may be labeled, too. As also has already been described above, it is also possible that an individual container 100 can be provided with more than one label 101 on different sections (circumference 110, neck section 105, head). The containers 100 then are moved by a neck section 105 within the apparatus 200 on the container transport path 7.

The invention has been described with reference to preferred embodiments. It is, however, obvious to a person skilled in the art that alterations and modifications are possible without leaving the scope of the subsequent claims.

What is claimed is:

1. Apparatus for labeling containers with different types of labels, comprising:

at least two labeling machines, each of the labeling machines including at least one labeling unit for applying labels to containers, each of the labeling machines having associated therewith an infeed star wheel and a discharge star wheel so that a container transport path is formed, along which the containers to be labeled are feedable under control to the at least two labeling machines, the at least two labeling machines including a first labeling machine and a second labeling machine, the containers labeled in the first labeling machine not running via the second labeling machine and the containers labeled in the second labeling machine not running via the first labeling machine and at least one type of label is processable with each of the at least two labeling machines, the containers being transported one after the other in the container transport path.

2. The apparatus as recited in claim 1 further comprising a control system controlling the infeed star wheels in such a way that for applying the selected type of label the individual containers are routable to that of the at least two labeling machines by which the selected type of label is processable.

3. The apparatus as recited in claim 1 wherein the at least two labeling machines are carousel-type machines.

4. The apparatus as recited in claim 1 wherein the at least one labeling unit for applying labels to containers is at least one unit for adhesive labels and/or one unit for direct printing of the labels onto the containers connected to the first labeling machine.

5. The apparatus as recited in claim 1 wherein the at least one labeling unit of the second labeling machine is a unit for applying sleeve labels round the containers.

6. The apparatus as recited in claim 5 wherein the second labeling machine has a first carousel and a second carousel, both of which are designed for applying sleeve labels to the containers.

7. The apparatus as recited in claim 6 wherein the first carousel and the second carousel are designed for stretch-sleeve labels and for shrink-sleeve labels.

8. The apparatus as recited in claim 6 wherein the first carousel is designed for stretch-sleeve labels and the second carousel is designed for shrink-sleeve labels.

9. The apparatus as recited in claim 1 wherein the container transport path within the apparatus is such that the containers are transportable at an even height.

10. The apparatus as recited in claim 1 wherein within the apparatus the containers in the container transport path at least on sections are movable by a neck section.

11. The apparatus as recited in claim 10 wherein during the labeling of empty containers the containers within the apparatus are movable by the neck section along the entire container transport path.

12. The apparatus as recited in claim 1 further comprising a curing unit and/or a film shrinking unit along a discharge conveyor of the apparatus.

13. The apparatus as recited in claim 12 wherein the film shrinking unit is a tunnel, through which the containers are transportable with the discharge conveyor.

14. The apparatus as recited in claim 12 wherein in the case of moving the containers by the neck section the film shrinking unit is a shrinking carousel.

15. An apparatus for labeling containers with different types of labels, comprising:

a first labeling machine, wherein the first labeling machine includes at least one unit for adhesive labels and/or one unit for direct printing of the labels onto the containers;

a second labeling machine, wherein the second labeling machine has a first carousel and a second carousel, both of which are designed for applying sleeve labels to the containers; and a first infeed star wheel and a first discharge star wheel positioned in relation to the first labeling machine and a second infeed star wheel and a second discharge star wheel positioned in relation to the second labeling machine so that a container transport path is formed, along which the containers to be labeled are feedable under control to the first or the second labeling machine and at least one type of label is processable with each of the first and second labeling machines so that the containers labeled in the first labeling machine do not run via the second labeling machine and the containers labeled in the second labeling machine do not run via the first labeling machine.

16. The apparatus as recited in claim 15 wherein the first carousel and the second carousel are designed to process stretch-sleeve labels and shrink-sleeve labels.

17. The apparatus as recited in claim 15 wherein the first carousel is designed to process stretch-sleeve labels and the second carousel is designed to process shrink-sleeve labels.

18. An apparatus for labeling containers with labels comprising:

at least a first labeling machine for transporting the containers to at least one first labeling unit, wherein the at least one labeling unit is applying adhesive labels and/or or direct printing of the labels onto the containers;

at least a second labeling machine for transporting the containers to at least one second labeling unit for applying sleeve labels to the containers; and a first infeed star wheel and a first discharge star wheel positioned in relation to the at least first and the at least second labeling machine, respectively, and a second infeed star wheel and a second discharge star wheel positioned in relation to the at least second labeling machine so that a container transport path is formed, along which the containers to be labeled are feedable under control to the at least first or the at least second labeling machine so that the containers labeled in the at least first labeling machine do not run via the at least second labeling machine and the containers labeled in the at least second labeling machine do not run via the at least first labeling machine.

19. The apparatus as recited in claim 18 further comprising a control system controlling the infeed star wheels in such a way that for applying the selected type of label the individual containers are routable to that of the at least first and second labeling machines by which the selected type of label is processable.

* * * * *